United States Patent [19]

Rudick

[11] Patent Number: 4,930,666

[45] Date of Patent: Jun. 5, 1990

[54] JUICE DISPENSING SYSTEM FOR A REFRIGERATOR DOOR

[75] Inventor: Arthur G. Rudick, Marietta, Ga.

[73] Assignee: The Coca-Cola Company, Atlanta, Ga.

[21] Appl. No.: 264,011

[22] Filed: Oct. 28, 1988

[51] Int. Cl.[5] ..... B67D 5/06

[52] U.S. Cl. ..... 222/181; 222/146.6; 222/160; 222/482; 222/484; 222/556; 215/313; 141/360

[58] Field of Search ..... 222/129.1, 146.6, 160, 222/484, 181, 506, 508, 536, 505, 556, 482; 215/309, 313, 533, 534; 137/588; 251/237, 248; 141/360, 361, 362

[56] References Cited

U.S. PATENT DOCUMENTS

| | | | |
|---|---|---|---|
| 608,271 | 8/1898 | Raiguel | 222/482 |
| 782,104 | 2/1905 | Brunner | 222/484 X |
| 1,314,489 | 8/1919 | Silverthorne | 222/482 |
| 1,790,228 | 1/1931 | Chambers | 222/484 X |
| 1,890,461 | 12/1932 | Hamburg | 222/536 X |
| 2,127,308 | 8/1938 | Rest | 222/482 |
| 2,127,465 | 8/1938 | Church | 222/484 X |
| 2,229,850 | 1/1941 | Hoskins | 222/181 X |
| 2,408,704 | 10/1946 | Taylor | 222/160 |
| 2,839,227 | 6/1958 | Wilson et al. | 222/484 |
| 2,971,664 | 2/1961 | Jacob | 222/482 |
| 2,979,238 | 4/1961 | Bramming | 222/484 |
| 2,990,980 | 7/1961 | Gronemeyer | 222/556 |
| 3,089,626 | 5/1963 | Kubiliunas | 222/484 |
| 3,178,061 | 4/1965 | Giacalone et al. | 222/146.6 X |
| 3,326,417 | 6/1967 | Tinsley | 141/362 X |
| 3,351,239 | 11/1967 | Flock | 141/361 X |
| 3,410,461 | 11/1968 | Barker | 222/556 X |
| 3,934,758 | 1/1976 | Kipp | 222/146.6 X |
| 4,382,529 | 5/1983 | Drdlik | 222/556 X |
| 4,519,529 | 5/1985 | Seltz | 222/484 |
| 4,674,656 | 6/1987 | Wiley et al. | 222/129.1 |

FOREIGN PATENT DOCUMENTS

| | | | |
|---|---|---|---|
| 144988 | 10/1935 | Fed. Rep. of Germany | 215/313 |
| 1078891 | 3/1960 | Fed. Rep. of Germany | 141/362 |
| 763782 | 5/1934 | France | 222/556 |
| 447478 | 4/1949 | Italy | 215/313 |
| 502610 | 3/1939 | United Kingdom | 222/556 |

OTHER PUBLICATIONS

Stocker's Specification, Dec. 11, 1879, No. 5064.

*Primary Examiner*—Kevin P. Shaver
*Assistant Examiner*—Boris Milef
*Attorney, Agent, or Firm*—Birch, Stewart, Kolasch & Birch

[57] ABSTRACT

An apparatus for dispensing a beverage by gravity feed from a container mounted in the outside of a door of a refrigerated cabinet, such as a home refrigerator, comprises a vented spout assembly for dispensing a beverage from a container by gravity feed at a substantially constant flow rate in combination with an actuation mechanism mounted in the door of the refrigerator. The vented spout assembly includes a valve assembly collar connectable to a discharge opening in the container, a vent tube extending from a location in the collar to a location in the container spaced from the discharge opening, the vent tube defining a vent passage therethrough. The collar has a discharge wall with a liquid discharge port therethrough. A rotary valve element is mounted for rotation in the discharge wall between OPEN and CLOSED positions. The rotary valve has a liquid discharge conduit and a vent conduit therethrough alignable with the discharge port and the vent passage, respectively, when in the OPEN position of the valve element, a spout extends from the liquid discharge conduit of the rotary valve element and an actuation lever extends from the rotary valve element for engagement with the actuation mechanism mounted in the door.

8 Claims, 4 Drawing Sheets

(OPEN POSITION)

(CLOSED POSITION)

(CLOSED)

(CLOSED)

(CLOSED)

(OPEN)

(CLOSED)

(OPEN)

(CLOSED)

(OPEN)

(CLOSED)

(OPEN)

JUICE DISPENSING SYSTEM FOR A REFRIGERATOR DOOR

BACKGROUND OF THE INVENTION

The present invention relates to a vented spout assembly for dispensing a beverage, such as citrus juice, from a container by gravity feed at a substantially constant flow rate. More specifically, the present invention relates to a juice dispenser apparatus mountable in an outside recess in a conventional home refrigerator door.

In recent years, home refrigerators have been designed to dispense chilled products such as water, ice and other beverages through the front doors thereof with the doors closed. Not only is this a convenience to the homeowner, it also saves energy by reducing the number of times that the doors must be opened and closed.

To be effective and useful, any front door dispensing system should be simple so it can be easily built into, or retrofit into, a refrigerator door. Furthermore, it must be easy to use and efficient in its operation.

When the beverage to be dispensed is a citrus juice product, there are additional requirements. For example, the juice should be dispensed at a substantially constant rate of flow, and the juice should be dispensed as a substantially homogeneous mixture.

SUMMARY OF THE INVENTION

Accordingly, it is a primary object of the present invention to provide a vented spout assembly for a gravity feed container which simultaneously dispenses a beverage and vents the container to the atmosphere, providing a substantially constant flow rate of beverage from the container.

It is another object of the present invention to provide a valve assembly adaptable for use on a container insertable into a recess in the outside of a refrigerator door, so dispensing from and venting of the container can be simultaneously achieved upon the insertion of a beverage serving receptacle into the recess.

It is a further object of the present invention to provide a system for dispensing citrus juice from a recess in the outside of a refrigeration door including the capability of automatically stirring the juice to maintain a substantially homogeneous mixture thereof.

It is yet another object of the present invention to provide a gravity feed container and associated valve assembly which is easily replaceable in a door of a refrigerator.

These and other objects of the present invention are fulfilled by providing a vented spout assembly for dispensing a beverage from a container by gravity feed at a substantially constant flow rate comprising: a valve assembly collar connectable to a discharge opening in the container; a vent tube extending from a location in said collar to a location in said container spaced from said discharge opening, said vent tube defining a vent passage therethrough; said collar having a discharge wall with a liquid discharge port therethrough; a rotary valve element mounted for rotation in said discharge wall between OPEN and CLOSED positions, said rotary valve element having a liquid discharge conduit and a vent conduit therethrough alignable with said liquid discharge port and said vent passage, respectively, when in said OPEN position; a spout extending from the liquid discharge conduit of said rotary valve element; and an actuation lever extending from said rotary valve element for moving said valve element between said OPEN and CLOSED positions.

The vented spout assembly is combined in a juice dispensing system by providing an apparatus for dispensing a beverage by gravity feed from a container mounted in the outside of a door of a refrigerator cabinet including, a vented spout assembly for dispensing a beverage from a container by gravity feed at a substantially constant flow rate comprising:

a valve assembly collar connectable to a discharge opening in the container; a vent tube extending from a location in said collar to a location in said container spaced from said discharge opening, said vent tube defining a vent passage therethrough; said collar having a discharge wall with a liquid discharge port therethrough; a rotary valve element mounted for rotation in said discharge wall between OPEN and CLOSED positions, said rotary valve element having a liquid discharge conduit and a vent conduit therethrough alignable with said liquid discharge port and said vent passage, respectively, when in said OPEN position; a spout extending from the liquid discharge conduit of said rotary valve element; and an actuation lever extending from said rotary valve element for moving said valve element between said OPEN and CLOSED positions; and actuation means mounted in said door, having a first end for engaging a receptacle to be filled with the beverage at a location spaced from the spout and a second end connectable to said actuation lever, whereby said rotary valve element is movable between said OPEN and CLOSED positions by the receptacle to be filled.

BRIEF DESCRIPTION OF THE DRAWINGS

The objects of the present invention and the attendant advantages thereof will become more readily apparent by reference to the accompanying drawings, wherein.

DETAILED DESCRIPTION OF PREFERRED EMBODIMENTS

Figure 2B:
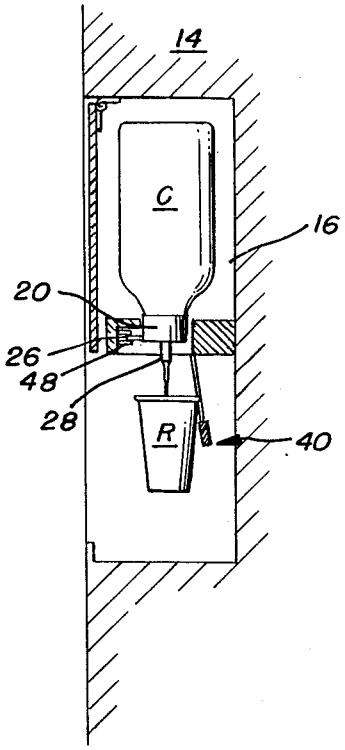
FIGS. 2A and 2B are cross-sectional views taken along line 2—2 of FIG. 1 showing the actuation mechanism of the juice dispensing system in closed and open positions, respectively.
Figure 2A:
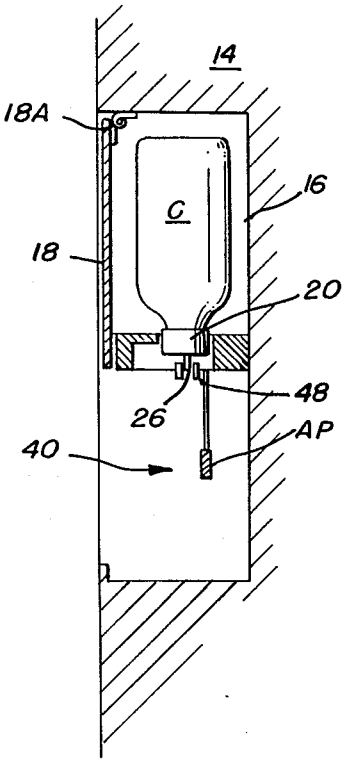
Figure 1:
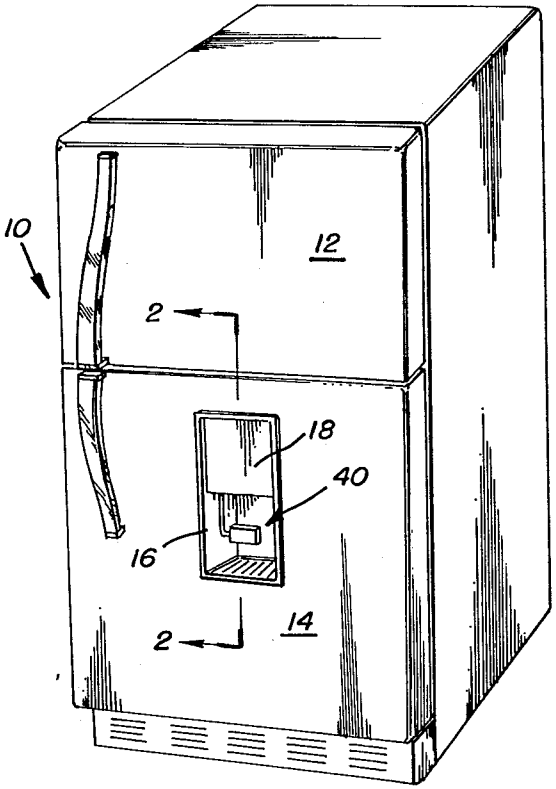
FIG. 1 is a perspective view of a home refrigerator with the juice dispensing system of the present invention mounted in a door thereof.

Referring in detail to FIGS. 1, 2A and 2B, there is generally indicated a refrigerator 10 having a freezer door 12 and a chilled food compartment door 14. Door 14 is provided with a cut-out or recess 16 which forms a dispensing station through the door. A hinged door 18 is provided in the top front of recess 16 to provide access to, and conceal a beverage container C therebehind. Container C may be supported in a suitable nest 58 illustrated in FIGS. 9A and 9B. The nest is omitted for clarity in FIGS. 1, 2A and 2B.

In a preferred embodiment, recess 16 is refrigerated by suitable means such as a cooling coil, or some heat transfer arrangement with the chilled food compartment of the refrigerator 10. However, means for cooling recess 16 forms no part of the present invention.

Container C is connected to a valve assembly collar 20 as illustrated in FIGS. 2A and 2B. Collar 20, an associated valve structure, dispensing spout 28 and vent means 32, 33, 34 will be described in detail hereinafter by reference to FIGS. 3, 4, 5A, 5B, 6A and 6B.

Figure 7A:
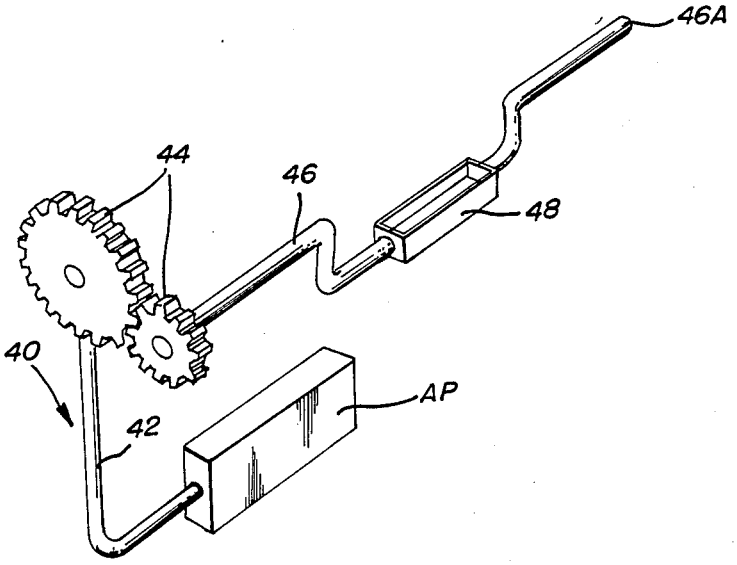
FIGS. 7A and 7B are perspective views of the actuation mechanism for operating the vented spout assembly shown in the closed and open positions, respectively, corresponding to the positions illustrated in FIGS. 2A and 2B.
Figure 7B:
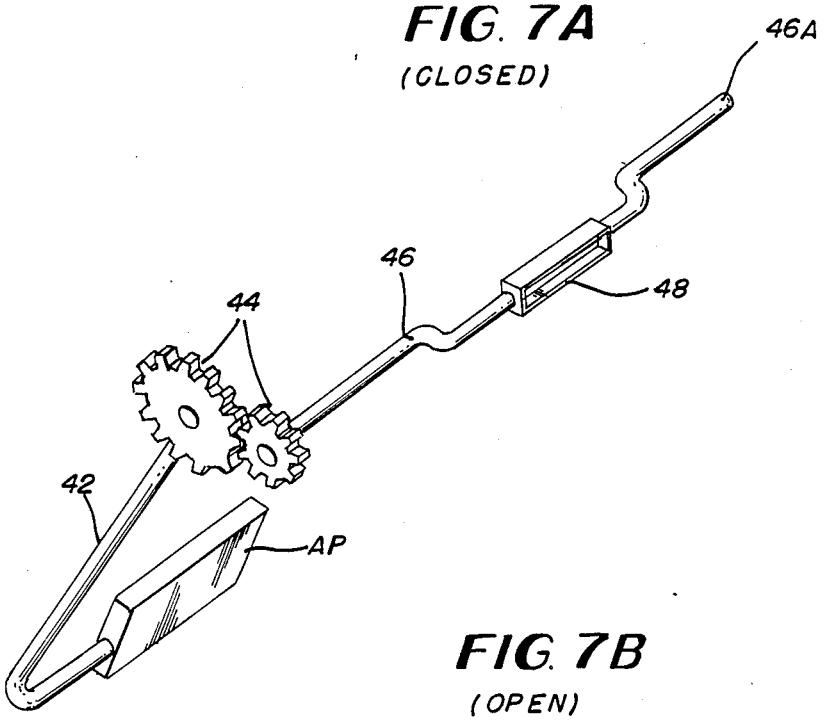

FIGS. 2A and 2B generally illustrate how container C and the vented spout assembly therefor within collar 20 are mounted in recess 16; and how a serving receptacle R is utilized to simultaneously initiate dispensing from and venting of container C. As illustrated in FIGS. 2A, when the vented spout assembly of the present invention is closed, actuation mechanism 40 has actuation pad AP vertically aligned below collar 20. Valve body lever 26 is also vertically oriented within slot 48 of actuation mechanism 40. When receptable R is inserted into recess 16, it presses against actuation pad AP and pushes it rearwardly, causing rotation of slot 48 and lever 16 forewardly as shown in FIG. 2B. This opens the vented spout in a manner to be described hereinafter. Details of actuation mechanism 40 are illustrated in FIGS. 7A, 7B and will also be described hereinafter.

Details of the vented spout assembly of the present invention and the manner in which dispensing and venting operations are simultaneously initiated are illustrated in FIGS. 3, 4, 5A, 5B, 6A and 6B. In the top plan view of FIG. 3, the external details of the vented spout assembly are illustrated. A valve assembly collar 20 is provided, and rotatably journalled therein is a cylindrical valve element 24 having protruding ends 24A and 24B. An integrally formed actuating lever 26 extends from rotary valve element 24 and an integrally formed spout 28 also extends from valve element 24 at approximately 90 degrees from the position of lever 26.

Figure 3:
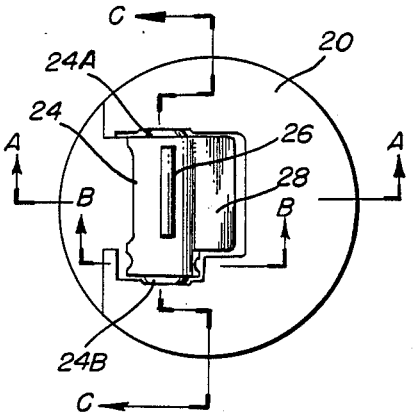
FIG. 3 is a top plan view of the vented spout assembly of the present invention.
Figure 4:
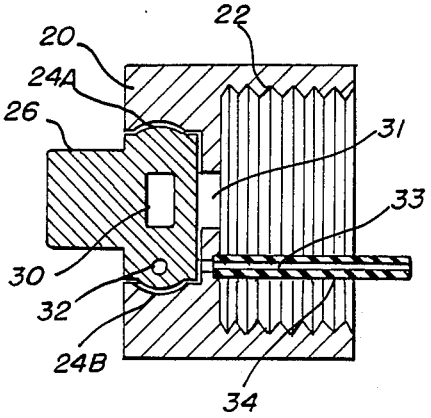
FIG. 4 is a cross-sectional view taken along line C—C of the vented spout assembly of FIG. 3.

Referring to FIG. 4, there is illustrated a cross-sectional view taken along line C—C of FIG. 3 to show the internal features of the vented spout assembly of the present invention. As illustrated, rotary valve element 24 includes a spout conduit 30 extending therethrough as well as through spout 28. Spout conduit 30 communicates with a discharge conduit 31 which communicates with the interior of container C. Container C preferably has a neck which screws into the threads of a socket 22. A valve body vent conduit 32 is also provided in rotary valve element 24, and is spaced from conduit 30 along the longitudinal axis of the rotary valve element. The vented spout assembly of the present invention illustrated in FIG. 4 is in the CLOSED position thereof, as is the apparatus illustrated in FIG. 3. Referring again to FIG. 4, there is illustrated a vent tube 34 with a vent passage 33 therein extending from adjacent rotary valve element 24 in collar 20 to a spaced position within container C above discharge conduit 31.

Figure 5A:
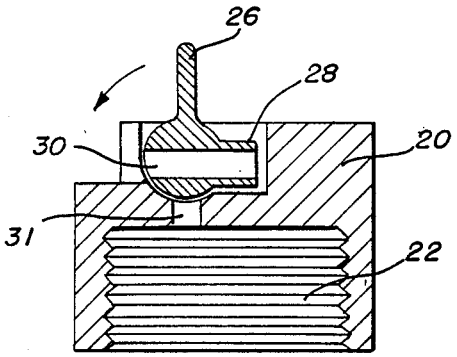
FIGS. 5A and 5B are cross-sectional views taken along line A—A of FIG. 3 showing the spout in the closed and open positions, respectively.
Figure 5B:
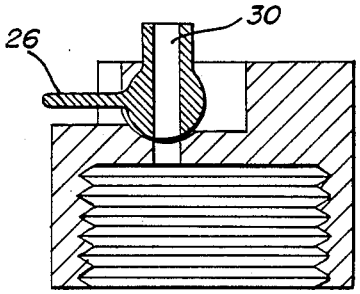

Referring to FIGS. 5A and 5B, which are cross sectional views taken along line A—A of FIG. 3, which illustrate the closed and opened positions, respectively, of the vented spout assembly, the operation of the discharge spout 28 and associated conduit 30 are clearly illustrated. In FIG. 5A, rotary valve element 24 is disposed in a CLOSED position, and discharge conduit 31 is sealed thereby. In this position, actuating lever 26 is axially aligned with discharge conduit 31, but no liquid can flow from the container C. When it is desired to open the container C and dispense liquid, lever 26 is rotated approximately 90 degrees to the position indicated in FIG. 5B to place spout conduit 30 in alignment with discharge conduit 31. In this position, liquid in container C is free to flow from the container.

Figure 6A:
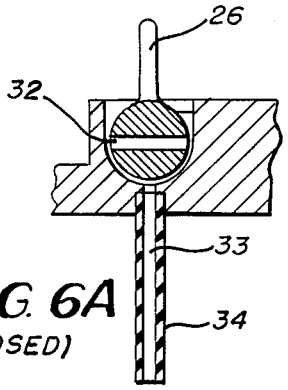
FIGS. 6A and 6B are cross-sectional views taken along line B—B of FIG. 3 showing the vent portion of the vented spout assembly in the closed and open positions, respectively.
Figure 6B:
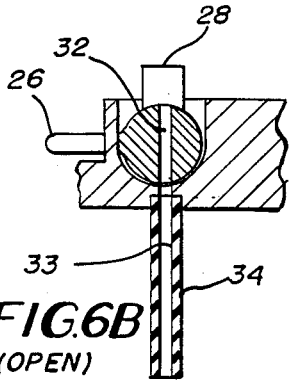

Referring to FIGS. 6A and 6B, which are cross sectional views taken along line B—B of FIG. 3, the operation of the venting function of the spout assembly of the present invention is illustrated. As illustrated in FIG. 6A, when the spout assembly is in a CLOSED position, valve body vent conduit 32 is disposed substantially orthogonally to vent passage 33 in vent tube 34. Clearly, in this position no venting of container C will result. However, when lever 26 is rotated approximately 90 degrees to the left as illustrated in FIG. 6A, the vent conduit 32 becomes aligned with vent passage 33 and vent tube 34, and venting of container C results. Accordingly, it can be seen that actuation of lever 26 causes the simultaneous dispensing of liquid from container C and the venting thereof to provide a substantially constant flow rate of liquid from the container.

The manner in which actuation lever 26 is rotated is illustrated in FIGS. 7A, 7B, 8A, and 8B. FIGS. 7A and 7B illustrate a preferred embodiment of an actuation mechanism 40 suitable for pivoting the lever 26 of the vented spout assembly. Actuation member 40 includes an actuation pad AP coupled via an L-shaped wire 42 to a reducing gear arrangement 44. Reducing gear arrangement 44 is in turn coupled to a shaft 46 which has an eccentric portion including a slotted connector 48. As illustrated in FIG. 1, the actuation mechanism 40 is disposed within recess 16 with L-shaped wire 42 and gears 44 built into the refrigerator door in any suitable fashion, and end 46A of shaft 46 suitably journalled in a sidewall recess 16. FIG. 7A illustrates actuation mechanism 40 in a similar position to FIG. 2A described hereinbefore, and FIG. 7B illustrates actuation mechanism 40 in an OPEN position of the vented spout assembly similar to the position illustrated in FIG. 2B.

Figure 8A:
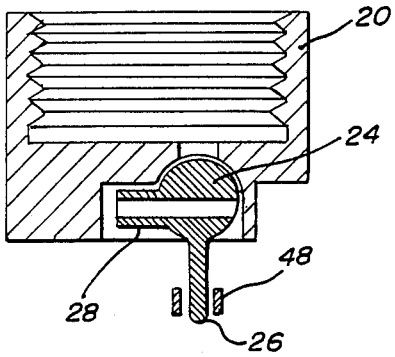
FIGS. 8A and 8B are cross-sectional views similar to FIGS. 5A and 5B showing details of how the actuation mechanism of FIGS. 7A and 7B moves the vented spout assembly between open and closed positions.
Figure 8B:
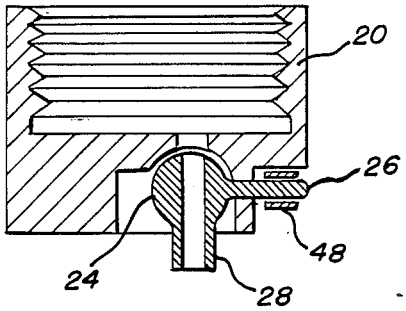

An enlarged view of the slotted connector 48 and actuation lever 26 of the vented spout assembly is illustrated in FIGS. 8A and 8B.

It should be clear by reference to FIGS. 2A, 2B, 7A, 7B, 8A and 8B, collectively, how actuation mechanism 40 is utilized to rotate lever 26 of the vented spout assembly and OPEN and CLOSE the same in response to the insertion of a serving receptable R.

Figure 9A:
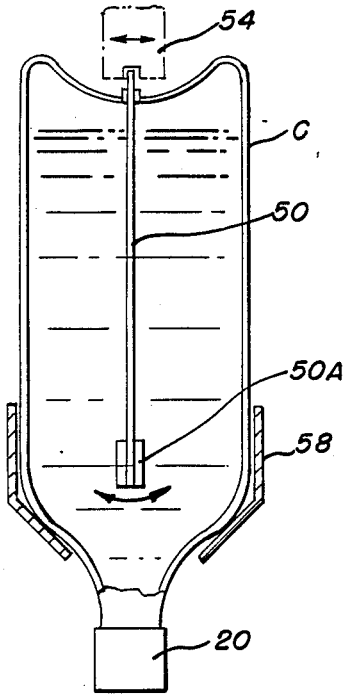
FIGS. 9A and 9B are first and second embodiments of agitator mechanisms which are utilized to stir the contents of the containers in the system of the present invention.
Figure 9B:
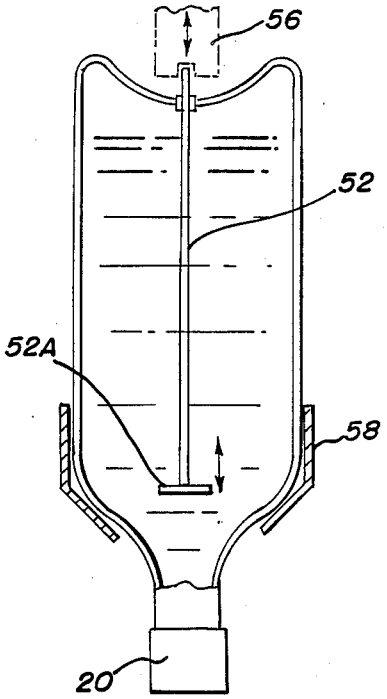

A further aspect of the present invention is illustrated in FIGS. 9A and 9B relates to a stirring system for preventing stratification of liquid in container C when the liquid is a citrus juice or the like. A first embodiment illustrated in FIG. 9A includes an agitator 50 having an impeller including a plurality of vanes 50A and a rapidly oscillating mechanism 54 which would be mounted in refrigerator door 14. A suitable, quick disconnect coupling between the upper end of agitator 50 and oscillating mechanism 54 would be provided to enable the quick and efficient insertion of container C into recess 16 of the refrigerator door. Agitator 50 would be manufactured with container C and disposable. Agitator 50 in this embodiment would be a side-to-side oscillating agitator.

In another possible embodiment, the agitator could be a reciprocating agitator 52 having a disc 52A on the end thereof and an oscillating mechanism 56 could be provided which vertically reciprocates in order to cause vertical reciprocation of agitator 52. The oscillating mechanisms 54 and 56 could be designed to cycle ON and OFF with a refrigeration compressor or any other suitable timing means could be utilized to achieve the proper amount of agitation to preclude stratification of the components of the juice as desired.

It is preferred that all the components of the vented spout assembly of the present invention, as well as container C and any agitators, be fabricated from plastic so that all components will be inexpensive, light-weight and disposable.

It should be understood that the system thus described may be modified as would occur to one of ordinary skill in the art without departing from the spirit and scope of the present invention.

What is claimed is:

1. A vented spout and actuator assembly for dispensing a beverage from a container by gravity feed at a substantially constant flow rate comprising:

a valve assembly collar connectable to a discharge opening in the container;

a vent tube extending from a location in said collar to a location in said container spaced from said discharge opening, said vent tube defining a vent passage therethrough;

said collar having a discharge wall with a liquid discharge port therethrough;

a rotary valve element mounted for rotation in said discharge wall between open and closed positions, said rotary valve element having a liquid discharge conduit and a vent conduit therethrough, alignable with said liquid discharge port and said vent passage, respectively, when in said open position;

a spout extending from the liquid discharge conduit of said rotary valve element; and an actuation lever separate from said spout extending from said rotary valve element for rotating said valve element between said open and closed position; and actuator means for said lever and having a first end for engagement by a beverage receptacle at a location spaced from said spout and a second end connected to said actuation lever, whereby said rotary valve element is movable between said open and closed positions by movement of the beverage receptacle for dispensing said beverage.

2. The vented spout assembly of claim 1 wherein said rotary valve element is cylindrical.

3. The assembly of claim 1 wherein said actuation lever is oriented at an angle of substantially 90° relative to said spout.

4. The assembly of claim 1 wherein said actuation lever depends vertically from said rotary valve element in said closed position and horizontally therefrom in said open position.

5. The assembly of claim 1 wherein said actuator means comprises an actuation pad at said firs end and being aligned with said spout, an L-shaped connector having a leg thereof extending outwardly from the actuation pad and a second leg extending at a right angle therefrom, said second leg being connected to reduction gear means, an actuation shaft extending outwardly from said reduction gear means, said actuation shaft having an eccentric portion including a slotted connector for receiving said actuation lever therein, whereby movement of the actuation pad orthogonally pivots the eccentric portion of the actuation shaft and the slotted connector to thereby move the actuation lever orthogonally to the open or closed positions of the valve element.

6. An apparatus for dispensing a beverage by gravity feed from a container mounted in the outside of a door of a refrigerated cabinet comprising:

(a) a vented spout assembly for dispensing a beverage from a container by gravity feed at a substantially constant flow rate including, a valve assembly collar connectable to a discharge opening in the container;

a vent tube extending from a location in said collar to a location in said container spaced from said discharge opening, said vent tube defining a vent passage therethrough;

said collar having a discharge wall with a liquid discharge port therethrough;

a rotary valve element mounted for rotation in said discharge wallbetween open and closed positions, said rotary valve element having a liquid discharge conduit and a vent conduit therethrough alignable with said liquid discharge port and said vent passage, respectively, when in said open position;

a spout extending from the liquid discharge conduit of said rotary valve element; and an actuation lever extending from said rotary valve element for moving said valve element between said open and closed positions; and (b) actuation means mounted in said door, having a first end for engaging a receptacle to be filled with the beverage at a location spaced from the spout and a second end connectable to said actuation lever, whereby said rotary valve element is movable between said open and closed positions by the receptable to be filled.

7. The apparatus of claim 6 wherein said actuation means comprises an actuation pad at said first end vertically aligned with said spout in a recess in said door, an L-shaped connector having a leg thereof extending horizontally from the actuation pad into a location in the door adjacent said recess and a second leg extending vertically in said door, said second leg being connected to reduction gear means, an actuation shaft extending horizontally from said reduction gear means into said recess in the door, said shaft having an eccentric portion including a slotted connector for receiving said actuation lever, whereby movement of the actuation pad orthogonally to the outside surface of said door pivots the eccentric portion of the actuation shaft and the slotted connector to thereby move the actuation lever orthogonally of the outside surface of the door to the open or closed positions of the valve element.

8. The apparatus of claim 6 further including agitator means in the container and oscillator means in said door, said agitator means being connectable to said oscillator means for being oscillated thereby.

* * * * *